US011339674B2

(12) United States Patent
Bailey

(10) Patent No.: US 11,339,674 B2
(45) Date of Patent: May 24, 2022

(54) BLADE RETAINER FOR GAS TURBINE ENGINE

(71) Applicant: Rolls-Royce North American Technologies Inc., Indianapolis, IN (US)

(72) Inventor: Patrick Bailey, Lebanon, IN (US)

(73) Assignee: Rolls-Royce North American Technologies Inc., Indianapolis, IN (US)

( * ) Notice: Subject to any disclaimer, the term of this patent is extended or adjusted under 35 U.S.C. 154(b) by 837 days.

(21) Appl. No.: 16/103,419

(22) Filed: Aug. 14, 2018

(65) Prior Publication Data

US 2020/0056491 A1 Feb. 20, 2020

(51) Int. Cl.

| | |
|---|---|
| ***F01D 5/32*** | (2006.01) |
| ***F01D 5/28*** | (2006.01) |
| ***F01D 5/30*** | (2006.01) |
| ***F04D 29/32*** | (2006.01) |

(52) U.S. Cl.

CPC ..... *F01D 5/323* (2013.01); *F01D 5/282* (2013.01); *F01D 5/3015* (2013.01); *F04D 29/322* (2013.01); *F05D 2240/24* (2013.01); *F05D 2240/80* (2013.01); *F05D 2240/90* (2013.01); *F05D 2260/70* (2013.01); *F05D 2260/941* (2013.01); *F05D 2300/603* (2013.01)

(58) Field of Classification Search

CPC ..... F01D 5/323; F01D 5/326; F01D 5/3007; F01D 5/3015

See application file for complete search history.

(56) References Cited

U.S. PATENT DOCUMENTS

| | | | | |
|---|---|---|---|---|
| 2,801,074 A * | 7/1957 | Brown | F01D 5/323 | 416/221 |
| 3,383,095 A | 5/1968 | Anderson | | |
| 3,632,228 A | 1/1972 | Acres | | |
| 3,936,234 A * | 2/1976 | Tucker | F01D 5/323 | 416/220 R |
| 4,208,170 A * | 6/1980 | Tucker | F01D 5/323 | 416/221 |
| 4,836,749 A * | 6/1989 | Gavilan | F01D 5/3046 | 416/218 |
| 5,259,728 A | 11/1993 | Szpunar et al. | | |
| 5,263,898 A | 11/1993 | Elston et al. | | |
| 5,425,621 A | 6/1995 | Maar | | |
| 5,584,659 A | 12/1996 | Schmidt | | |
| 5,720,596 A | 2/1998 | Pepperman | | |

(Continued)

FOREIGN PATENT DOCUMENTS

| | | |
|---|---|---|
| DE | 10031116 A1 | 1/2002 |
| GB | 2021206 A1 | 11/1979 |

OTHER PUBLICATIONS

Extended European Search Report, European Application No. 19190916.7-1004, dated Mar. 23, 2020, 13 pages.

*Primary Examiner* — Richard A Edgar
*Assistant Examiner* — John S Hunter, Jr.
(74) *Attorney, Agent, or Firm* — Barnes & Thornburg LLP

(57) ABSTRACT

A blade retainer adapted for use in a gas turbine engine is configured to block axial movement of a blade. The blade retainer includes a first brace, a second brace, and a web that extends between the first brace and the second brace. The blade retainer is configured to block axial movement of a root of the blade out of a blade receiver slot.

14 Claims, 6 Drawing Sheets

(56) References Cited

U.S. PATENT DOCUMENTS

| | | | | |
|---|---|---|---|---|
| 6,481,971 | B1 * | 11/2002 | Forrester | F01D 11/008 416/221 |
| 8,061,995 | B2 | 11/2011 | Prince et al. | |
| 8,764,402 | B2 | 7/2014 | Agaram et al. | |
| 9,695,699 | B2 | 7/2017 | Pernleitner et al. | |
| 2008/0273982 | A1 | 11/2008 | Chunduru et al. | |
| 2018/0112543 | A1 | 4/2018 | Thomas et al. | |

* cited by examiner

BLADE RETAINER FOR GAS TURBINE ENGINE

STATEMENT REGARDING FEDERALLY SPONSORED RESEARCH OR DEVELOPMENT

Embodiments of the present disclosure were made with government support under NASA Contract No. NNC14CA29C (Phase III). The government may have certain rights.

FIELD OF THE DISCLOSURE

The present disclosure relates generally to fan blade assemblies for use in gas turbine engines, and more specifically to fan blade restraints that limit movement of fan blades.

BACKGROUND

Gas turbine engines are used to power aircraft, watercraft, power generators, and the like. Gas turbine engines typically include a fan, a compressor, a combustor, and a turbine. The compressor compresses air drawn into the engine by the fan and delivers high pressure air to the combustor. In the combustor, fuel is mixed with the high pressure air and is ignited. Products of the combustion reaction in the combustor are directed into the turbine where work is extracted to drive the compressor and, sometimes, an output shaft. Left over products of the combustion are exhausted out of the turbine and may provide thrust in some applications.

The fan assembly generally includes a hub having a plurality of fan blades that rotate about a center axis of the gas turbine engine. Some fixed pitch dovetail fan blades require adjacent blade exerting forces on the dovetail surfaces to prevent any bending of the disc lug posts. In a variable pitch fan blade, each blade is independent of each other therefore the prying force to open the dovetail has no counteracting force. This exerts force on the dovetail that can create bending forces and generate edge loading on the corners of the dovetail. Given solidity constraints at the hub, there is less bearing area to support the dovetail blade load. Variable pitch fan blade design can also be challenging because of other solidity constraints near the hub. Accordingly, additional design options related to variable pitch fan blade systems are needed.

SUMMARY

The present disclosure may comprise one or more of the following features and combinations thereof.

A blade assembly for use with a gas turbine engine is disclosed in this application. The blade assembly includes a blade configured to rotate about a center axis during operation of the gas turbine engine, a blade holder configured to support the blade as the blade rotates about the center axis, and a blade retainer configured to block axial movement of the root of the blade out of the blade receiver slot. The blade includes a root and an airfoil that extends radially away from the root. The blade holder includes a base, a first post, and a second post that cooperate to define a blade receiver slot that extends axially through a fore face and an aft face of the blade holder. The receiver slot also receives the root of the blade such that the first post and the second post block radial movement of the root of the blade out of the blade receiver slot.

In illustrative embodiments, the blade retainer includes an outer stop and a retainer insert. The retainer insert includes a web, a fore brace, and an inner stop. The web extends axially between a fore end and an aft end. The fore brace is coupled to the fore end of the web. The inner stop extends radially inward away from the web adjacent the aft end of the web. The outer stop is aligned axially with the inner stop and is coupled to the web to cause the outer stop and the inner stop to cooperate thereby providing an aft brace that is spaced apart axially from the fore brace. The fore brace is configured to engage the root of the blade and the fore face of the blade holder. The aft brace is configured to engage the root of the blade and the aft face of the blade holder. The web blocks relative movement between the fore brace and the aft brace so that the blade retainer blocks axial movement of the root of the blade out of the blade receiver slot.

In illustrative embodiments, the outer stop includes a radially extending abutment wall and a flange that extends axially away from the abutment wall. The web is formed to include a channel that extends radially into the web and a portion of the abutment wall is received in the channel to locate the outer stop axially relative to the retainer insert. The channel is aligned axially with the inner stop.

In illustrative embodiments, the blade retainer further includes a fastener that extends through the flange of the outer stop and the aft end of the web to couple the outer stop to the retainer insert. The blade retainer may further include a bond layer located between the flange of the outer stop and the aft end of the web to couple the outer stop to the retainer insert. In some embodiments, the outer stop may be removably coupled to the retainer insert.

In illustrative embodiments, the fore brace may be solid, continuous, and circular when viewed axially relative to the center axis. The fore brace, the web, and the inner stop are integrally formed as a single component. The fore brace may be solid, continuous, and rectangular when viewed axially relative to the center axis.

According to another aspect of the present disclosure, a blade retainer includes a first stop and a retainer insert. The retainer insert includes a web having a first end and a second end spaced apart axially from the first end relative to an axis, a first brace that extends radially outward and radially inward away from the web, and a second stop that extends radially inward away from the web. The first brace is located at the first end of the web and the first stop is coupled to the web at the second end of the web to cause the first stop and the second stop to provide a second brace.

In illustrative embodiments, the first stop includes a radially extending abutment wall and a flange that extends axially away from the abutment wall. The web is formed to include a channel that extends radially into the web. A portion of the abutment wall may be received in the channel to locate the first stop axially relative to the retainer insert.

In illustrative embodiments, the channel is aligned axially with the second stop. The blade retainer further includes a fastener that extends through the flange of the first stop and the second end of the web to couple the first stop to the retainer insert. The blade retainer may further include a bond layer located between the flange of the first stop and the second end of the web to couple the first stop to the retainer insert. In some embodiments, the first stop is removably coupled to the retainer insert.

In illustrative embodiments, the blade retainer may be part of an assembly that further includes a blade holder and a blade. The blade holder may have a first face and a second face spaced apart from the first face. The blade may have a root and an airfoil that extends away from the root. The root of the blade may be received in the blade holder. In some such embodiments, the web of the blade retainer is located between the root of the blade and the blade holder, the first brace is adapted to engage with the first face of the blade holder, and the second brace is adapted to engage with the second face of the blade holder.

In illustrative embodiments, the web has a circumferential width and the first brace has a circumferential width. In some such embodiments, the circumferential width of the first brace may be equal to the circumferential width of the web.

According to another aspect of the present disclosure, a method of making a blade retainer adapted to block axial movement of a blade in a gas turbine engine is disclosed. The method may include providing a first segment of a bar stock comprising metallic material. The method may further include removing material from the first segment of the bar stock to form an integral retainer insert that includes: (i) a web that extends axially relative to an axis of the bar stock, (ii) a first brace that extends radially outward and radially inward away from the web, and (iii) a first stop that extends radially away from the web, the first brace being spaced apart axially from the first stop.

In illustrative embodiments, the method may include providing a second segment of the bar stock. The method may then include removing material from the second segment of the bar stock to form a second stop that includes an abutment wall and a flange that extends axially away from the abutment wall.

In illustrative embodiments, the bar stock used in the disclosed method is cylindrical. However, other bar stock shapes can also be used.

These and other features of the present disclosure will become more apparent from the following description of the illustrative embodiments.

DETAILED DESCRIPTION OF THE DRAWINGS

Figure 1:
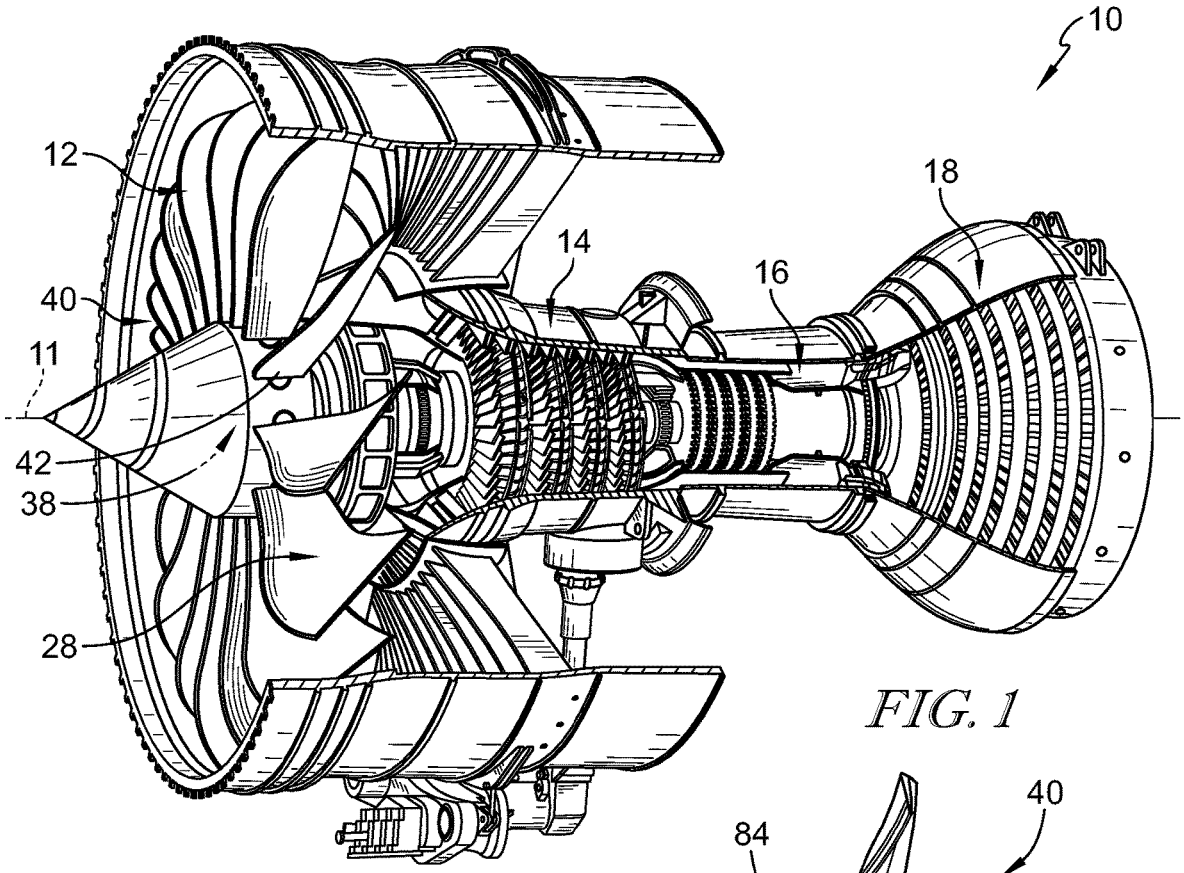
FIG. 1 is a cutaway view of a gas turbine engine that includes a variable pitch fan, a compressor, a combustor, and a turbine, the variable pitch fan including a plurality of fan blade assemblies mounted for rotation about an axis of the gas turbine engine to produce thrust and configured to have their pitch varied during operation of the gas turbine engine.

For the purposes of promoting an understanding of the principles of the disclosure, reference will now be made to a number of illustrative embodiments illustrated in the drawings and specific language will be used to describe the same.

A gas turbine engine 10 in accordance with the present disclosure is shown in FIG. 1. The gas turbine engine 10 includes a variable pitch fan 12, a compressor 14, a combustor 16, and a turbine 18. The fan 12 is driven by the turbine 18 and provides thrust for propelling an aircraft. The compressor 14 compresses and delivers air to the combustor 16. The combustor 16 mixes fuel with the compressed air received from the compressor 14 and ignites the fuel. The hot, high pressure products of the combustion reaction in the combustor 16 are directed into the turbine 18 to cause the turbine 18 to rotate about a center axis 11 of the gas turbine engine 10 and drive the compressor 14 and the fan 12.

A gas turbine engine 10 in accordance with the present disclosure is shown in FIG. 1. The gas turbine engine 10 includes a variable pitch fan 12, a compressor 14, a combustor 16, and a turbine 18. The fan 12 is driven by the turbine 18 and provides thrust for propelling an aircraft. The compressor 14 compresses and delivers air to the combustor 16. The combustor 16 mixes fuel with the compressed air received from the compressor 14 and ignites the fuel. The hot, high pressure products of the combustion reaction in the combustor 16 are directed into the turbine 18 to cause the turbine 18 to rotate about a center axis 11 of the gas turbine engine 10 and drive the compressor 14 and the fan 12.

The illustrative fan 12 is a variable pitch fan 12 that includes a plurality of fan blade assemblies 40 extending from a hub 38 and that each include a fan blade holder 42 and a fan blade 28 mounted in the fan blade holder 42. The fan blade assembly 40 is configured to rotate about the center axis 11 as suggested in FIG. 1 such that the fan blades 28 produce thrust. The fan blade assemblies 40 are arranged circumferentially about the center axis 11 and are configured to rotate about corresponding radially extending fan blade pivot axes 30 to change a pitch (sometimes called an incident angle) of the fan blades 28.

As one example, the pitch of the fan blades 28 may be varied to optimize fuel burn throughout a flight mission. The pitch of the fan blades 28 may be reversed to provide thrust reverse and reduce or eliminate the use of heavy thrust reverse units coupled to the engine nacelle. The fan blades 28 may be feathered in the event of an engine failure to reduce drag or windmill loads.

Figure 2:
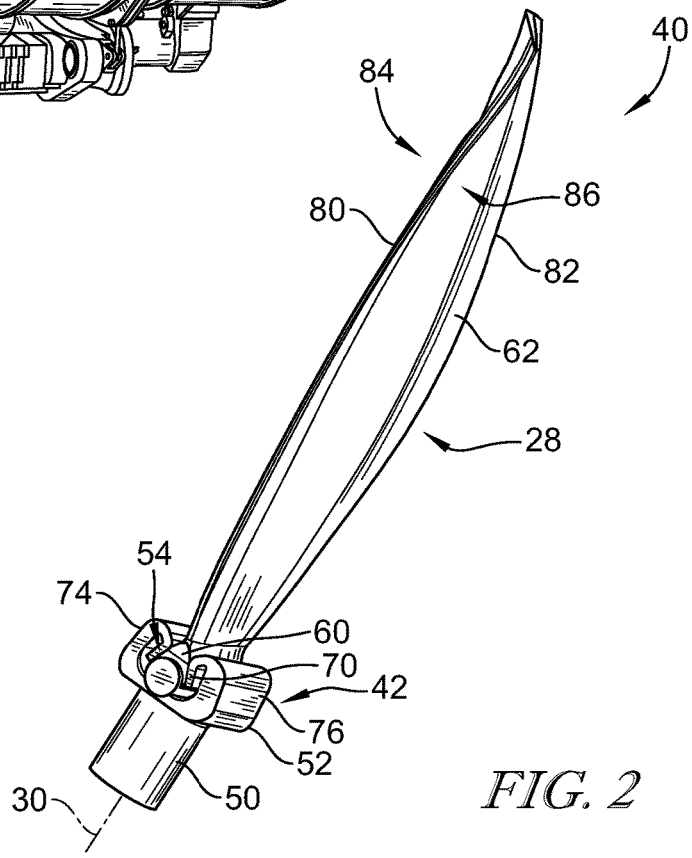
FIG. 2 is a perspective view of one of the fan blade assemblies of FIG. 1 showing that the fan blade assembly includes a fan blade holder, a fan blade received in a slot formed in the fan blade holder, and a blade retainer.

Referring to FIG. 2, a fan blade assembly 40 includes the fan blade holder 42 and the fan blade 28. The fan blade holder 42 includes a metallic material and is configured to retain the fan blade 28 as the fan blade 28 rotates about the center axis 11. The fan blade 28 may be a composite material, e.g. organic composite, ceramic matrix composite, or carbon composite. The fan blade holder 42 is adapted to rotate selectively about the fan blade pivot axis 30 to vary a pitch of the fan blade 28. The fan blade holder 42 includes a shank 50 and a blade restraint 52 that extends between an aft face 98 and a fore face 106. The shank 50 is generally cylindrical in shape and extends along the fan blade pivot axis 30. The shank 50 is configured to position in an opening of the hub 38. The shank 50 rotates about the fan blade pivot axis 30 within the opening of the hub 38. The blade restraint 52 extends radially outward from the shank 50 and includes a dovetail shaped blade receiver slot 54.

The fan blade 28 includes a composite material and is configured to rotate about the center axis 11 during operation of the gas turbine engine 10. The fan blade 28 includes a dovetail shaped root 60 and an airfoil 62 extending radially outward from the root 60. The root 60 is positioned within the blade receiver slot 54 so that the fan blade 28 is secured to the fan blade holder 42. The airfoil 62 includes a leading edge 80 and an opposite trialing edge 82. A suction side 84 of the airfoil 62 extends between the leading edge 80 and the trialing edge 82. A pressure side 86 of the airfoil 62 extends between the leading edge 80 and the trialing edge 82 opposite the suction side 84. A blade retainer 130 is positioned between the fan blade 28 and the fan blade holder 42.

Figure 3:
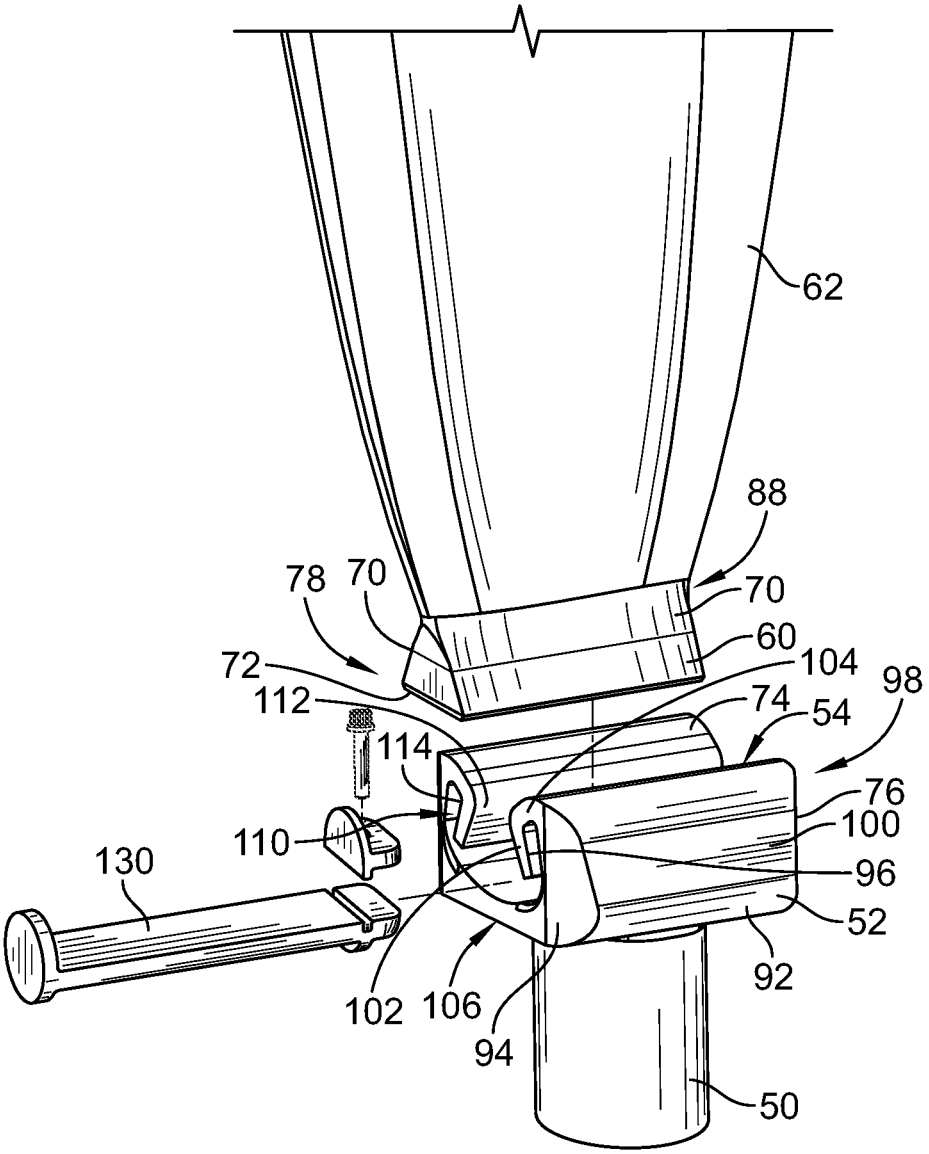
FIG. 3 is an exploded view of one of the fan blade assemblies shown in FIG. 1 and a blade retainer configured to couple to the fan blade assembly to reduce forward and aft movement of the fan blade.

Referring to FIG. 3, the root 60 has a pair of angled mating surfaces 70 extending from a bottom surface 72 to the airfoil 62. The root 60 is positioned within the blade receiver slot 54 so that the angled mating surfaces 70 engage a post 74 and a post 76 of the fan blade holder 42. The mating surfaces 70 extend between a front face 78 and a rear face 88. The fan blade holder 42 includes the shank 50 and a blade restraint 52 that extends radially outward from the shank 50. The blade restraint 52 includes a base 92. The posts 74 and 76 are generally hook shaped and extend radially outward from the base 92 so that the posts 74, 76 and the base 92 define the blade receiver slot 54.

The posts 74, 76 extend between the aft face 98 and the fore face 106 of the blade restraint 52. Each post 74, 76 includes a fixed end 94 coupled to the base 92 and a free end 96. The free end 96 is positioned radially outward from the fixed end 94. Each post 74, 76 includes an outer wall 100 and an inner wall 102 coupled by a join wall 104, the outer wall 100 being thicker than the inner wall 102. The outer wall 100, the join wall 104, and the inner wall 102 are solid and integrally formed. The outer wall 100 extends radially outward from the base 92. The join wall 104 extends at an angle relative to the outer wall 100 toward the opposite post 74, 76. The join wall 104 extends at an orthogonal angle relative to the outer wall 100. The inner wall 102 extends radially inward from the join wall 104 into the blade receiver slot 54. The inner wall 102 is cantilevered from the join wall 104.

A relief slot 110 is defined between the outer wall 100 and the inner wall 102. The relief slot extends through the fore face 106 and the aft face 98. That is, the inner wall 102 is spaced apart from the outer wall 100 to locate the relief slot 110 therebetween. The relief slot 110 extends radially relative to the center axis 11 through the post 74, 76 and opens into the blade receiver slot 54.

Each relief slot 110 is L shaped and includes an opening that faces the opposite post 74, 76. The relief slots 110 enable the posts 74, 76 to deform and distribute contact pressure along the mating surfaces 70 of the dovetail shaped root 60 in response to the fan blade 28 being urged radially outward relative to the center axis 30 by centrifugal forces acting on the fan blade 28 during operation of the gas turbine engine 10.

The inner wall 102 includes a planar engagement surface 112 and an inner surface 114. The engagement surface 112 is continuous such that it is formed without holes. The blade receiver slot 54 is defined between the engagement surfaces 112 of the posts 74, 76. The relief slot 110 is defined between the inner surface 114 and the outer wall 100. The engagement surface 112 is configured to engage the root 60 of the fan blade 28. Particularly, an angled mating surface 70 of the root 60 is configured to engage the engagement surface 112 of each post 74, 76 when the fan blade 28 is coupled to the fan blade holder 42 to block radial movement of the fan blade 28 out of the blade-receiver slot 54 relative to the center axis 11.

The fan blade 28 is configured to position in the fan blade holder 42 so that as air gap is formed between the root 60 of the fan blade 28 and the base 92 of the fan blade holder 42. When the gas turbine engine 10 is operated, centrifugal forces act on the fan blade 28. These forces move the fan blade 28 radially outward causing stresses to be created between the mating surfaces 70 of the root 60 and the engagement surfaces 112 of the posts 74, 76. Generally, these stresses may be non-uniform resulting in an uneven distribution of stress on the posts 74, 76. The uneven distribution of stress results in pressure points that may cause failures of the posts 74, 76, thereby resulting in the fan blade 28 becoming dislodged from the blade restraint 52.

To uniformly distribute the forces acting between the blade restraint 52 and the root 60, the inner walls 102 of the posts 74, 76 deform outward. That is, the inner walls 102 deform into the relief slots 110. The inner walls 102 are deformed so that the mating surfaces 70 of the root 60 maintain a substantially uniform engagement with the engagement surfaces 112. The uniform engagement results in the stresses being uniformly distributed across the engagement surfaces 112 to reduce the occurrence of pressure points on the posts 74, 76, thereby limiting failures in the blade restraint 52. It should be noted that the inner walls 102 deform to a point that uniformly distributes the stress while retaining the fan blade 28 in the fan blade holder 42.

Figure 4:
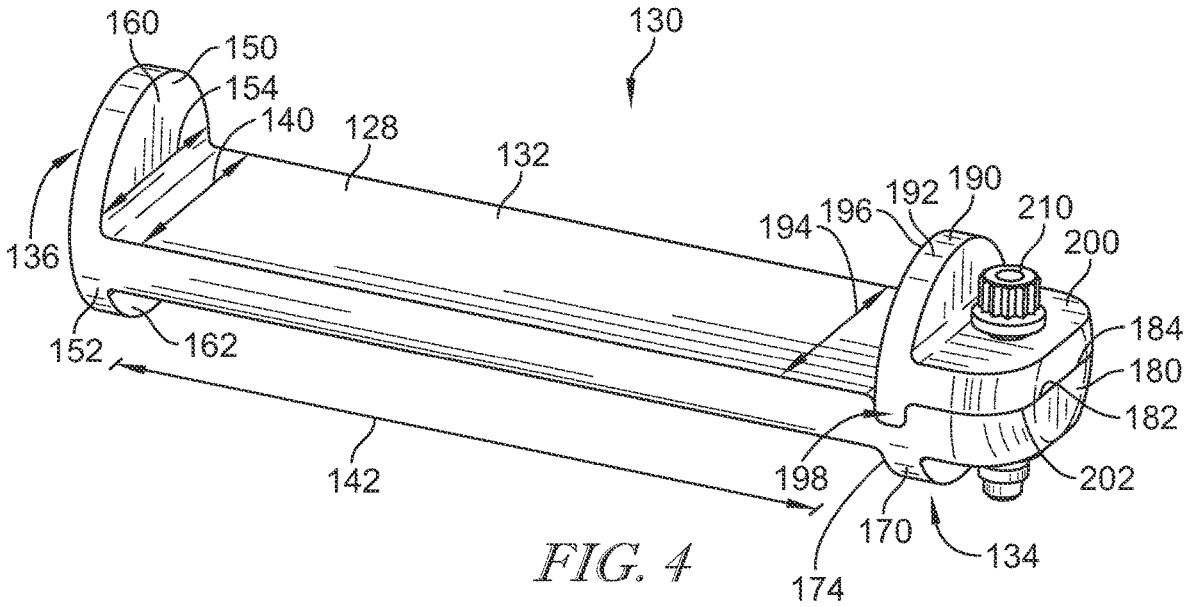
FIG. 4 is a perspective view of a blade retainer including an outer stop coupled to a retainer insert.

The blade retainer 130 is configured to position in the air gap between the fan blade 28 and the fan blade holder 42. Referring to FIG. 4, the blade retainer 130 includes an outer stop 190 that is configured to couple to a retainer insert 128. The retainer insert 128 includes a web 132 extending between an aft brace 134 and a fore brace 136. The web 132 has a width 140 that is sized to be received in the blade receiver slot 54. A length 142 of the web 132 is substantially the same as a length of the blade receiver slot 54 between the aft face 98 and the fore face 106.

The fore brace 136 is generally circular in shape and includes an inner stop 150 extending radially outward and an inner stop 152 extending radially inward. The fore brace 136 is solid, continuous, and circular when viewed axially relative to the center axis 11. The fore brace 136, the web 132, and the inner stops 150, 152 are integrally formed as a single component. The fore brace 136 has a diameter 154 that is substantially the same as width 140 of the web 132. The fore brace 136 includes a pair of engagement surfaces 160, 162 that engage the fore face 106 of the blade restraint 52 and the front face 78 of the root 60. The engagement surface 160 is positioned on the inner stop 150, and the engagement surface 162 is positioned on the inner stop 152.

The aft brace 134 include a substantially semi-circular abutment wall 170. The abutment wall 170 has a circumferential width that is substantially the same as the circumferential width 140 of the web 132. The abutment wall 170 extends radially inward from the web 132. An engagement surface 174 of the abutment wall 170 is configured to engage the aft face 98 of the blade restraint 52 and the rear face 88 of the root 60. A flange 180 extends in an aft direction from the abutment wall 170. The flange 180 is substantially planar with the web 132. The flange 180 includes a mating surface 182 on the radially outward face 184.

The outer stop 190 is removably coupled to the flange 180 to secure the blade retainer 130 to the fan blade assembly 40. The outer stop 190 is aligned axially with the inner stop 150.

The outer stop 190 includes a semi-circular abutment wall 192 that extends radially outward from the web 132. The web 132 is formed to include a channel 198 that extends radially into the web 132 and a portion of the abutment wall 192 is received in the channel 198 to locate the outer stop 190 axially relative to the retainer insert 128. The channel 198 is aligned axially with the inner stop 150. The abutment wall 192 has a circumferential width 194 that is substantially the same as the circumferential width 140 of the web 132. The abutment wall 192 includes an engagement surface 196 that is configured to engage the aft face 98 of the blade restraint 52 and the rear face 88 of the root 60.

A flange 200 extends axially away from the abutment wall 192 in an aft direction. The flange 200 includes a mating surface 202 that engages the mating surface 182 of the flange 180.

Figure 5:
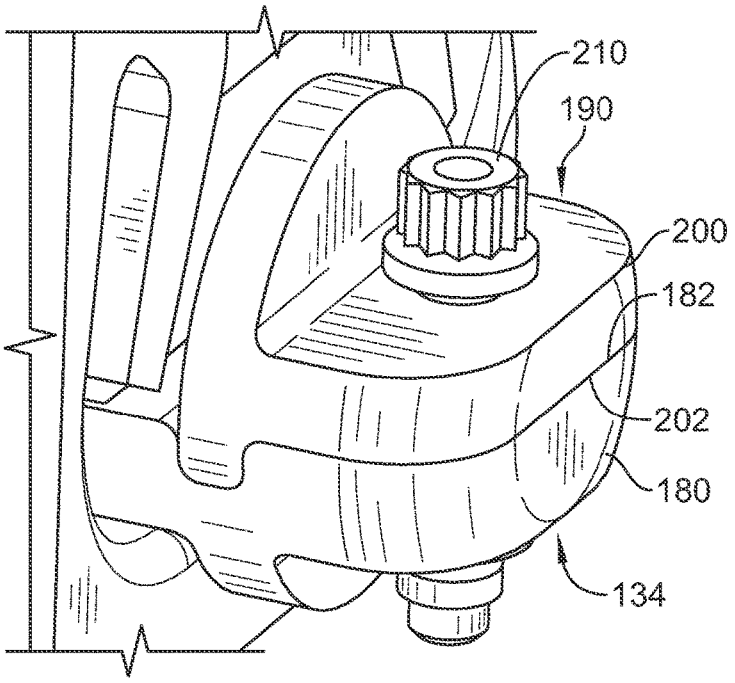
FIG. 5 is an expanded view of the outer stop shown in FIG. 4 coupled to the retainer insert shown in FIG. 4.
Figure 6:
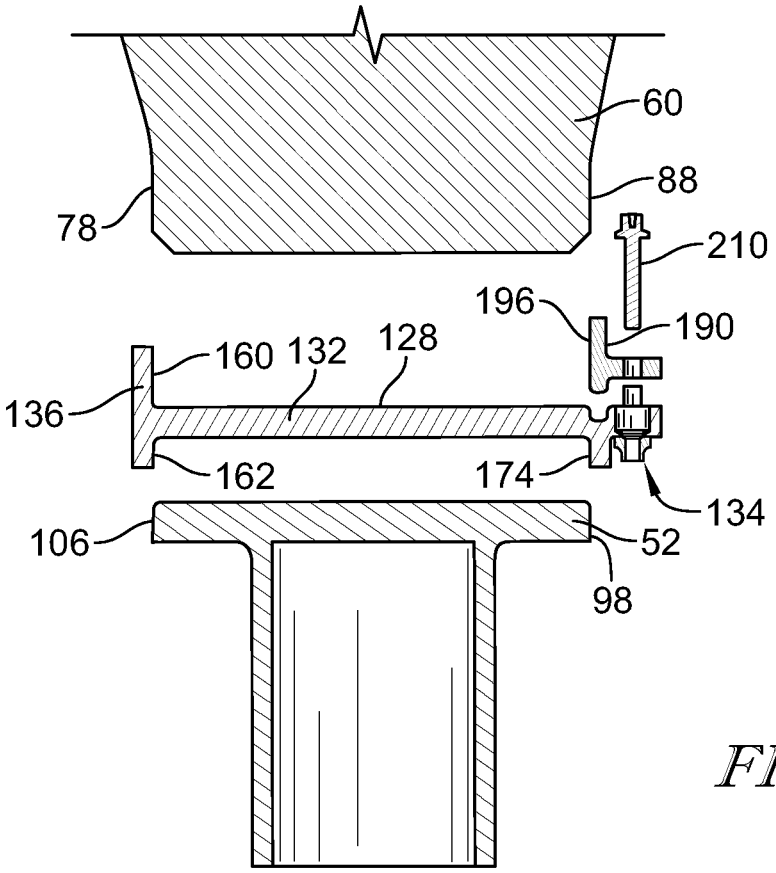
FIG. 6 is an exploded view of the blade retainer of FIG. 4 configured to couple between the fan blade shown in FIG. 3 and the blade holder shown in FIG. 3.

Referring to FIG. 5, the mating surface 202 of the flange 200 is secured against the mating surface 182 of the flange 180. A fastener 210 is extended through the flanges 180 and 200 to secure the outer stop 190 to the aft brace 134. Referring to FIG. 6, the retainer insert 128 is positioned between the root 60 and the blade restraint 52. That is, with the outer stop 190 removed from the retainer insert 128, the web 132 of the retainer insert 128 is configured to be slid into the air gap between the root 60 and the blade restraint 52 so that the aft brace 134 is positioned outside of the air gap aft of the fan blade assembly 40.

Figure 7:
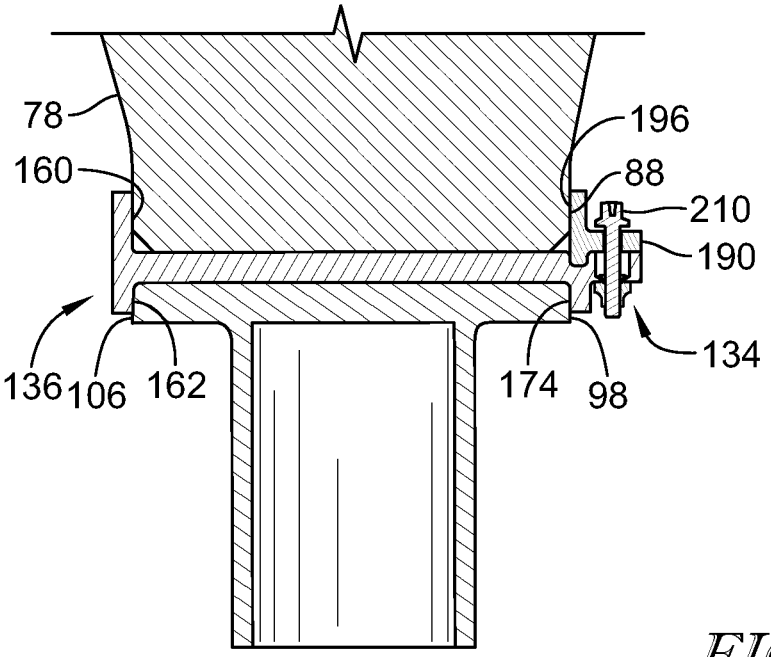
FIG. 7 is a side elevation view of the blade retainer of FIG. 4 coupled between the fan blade shown in FIG. 3 and the blade holder shown in FIG. 3.

As shown, in FIG. 7, when the outer stop 190 is fastened to the aft brace 134, the blade retainer 130 is secured between the root 60 and the blade restraint 52 so that the engagement surfaces 160, 162 are secured against the fore face 106 of the blade restraint 52 and the front face 78 of the root 60. The engagement surfaces 174, 196 are secured against the aft face 98 of the blade restraint 52 and the rear face 88 of the root 60. In this configuration, the blade retainer 130 is configured to prevent forward and aft movement of the fan blade 28 relative to the blade restraint 52.

Figure 8:
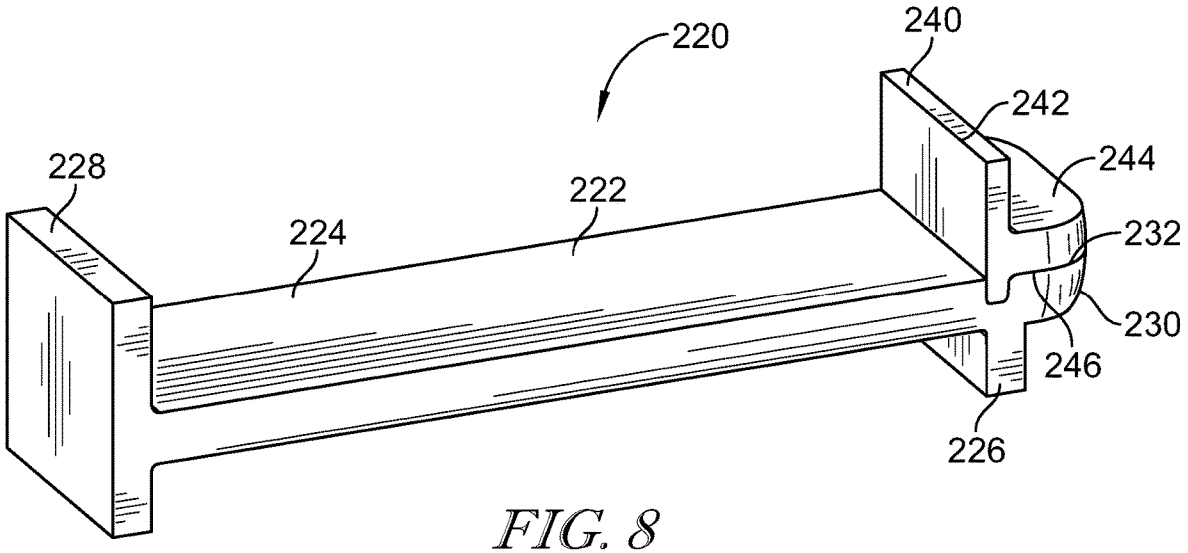
FIG. 8 is a perspective view of another embodiment of a blade retainer having an outer stop bonded to a retainer insert.

Referring to FIG. 8 a blade retainer 220 includes a retainer insert 222 having a web 224 extending between a squared aft brace 226 and a rectangular fore brace 228. The fore brace 228 is solid, continuous, and rectangular when viewed axially relative to the center axis. A flange 230 having a mating surface 232 extends from the aft brace 226. An outer stop 240 is configured to join to the flange 230. The outer stop 240 includes a rectangular aft flange 242 and a mating flange 244 extending from the aft flange 242. The mating flange 244 includes a mating surface 246 that is configured to be bonded to the mating surface 232 of the flange 230.

Figure 9:
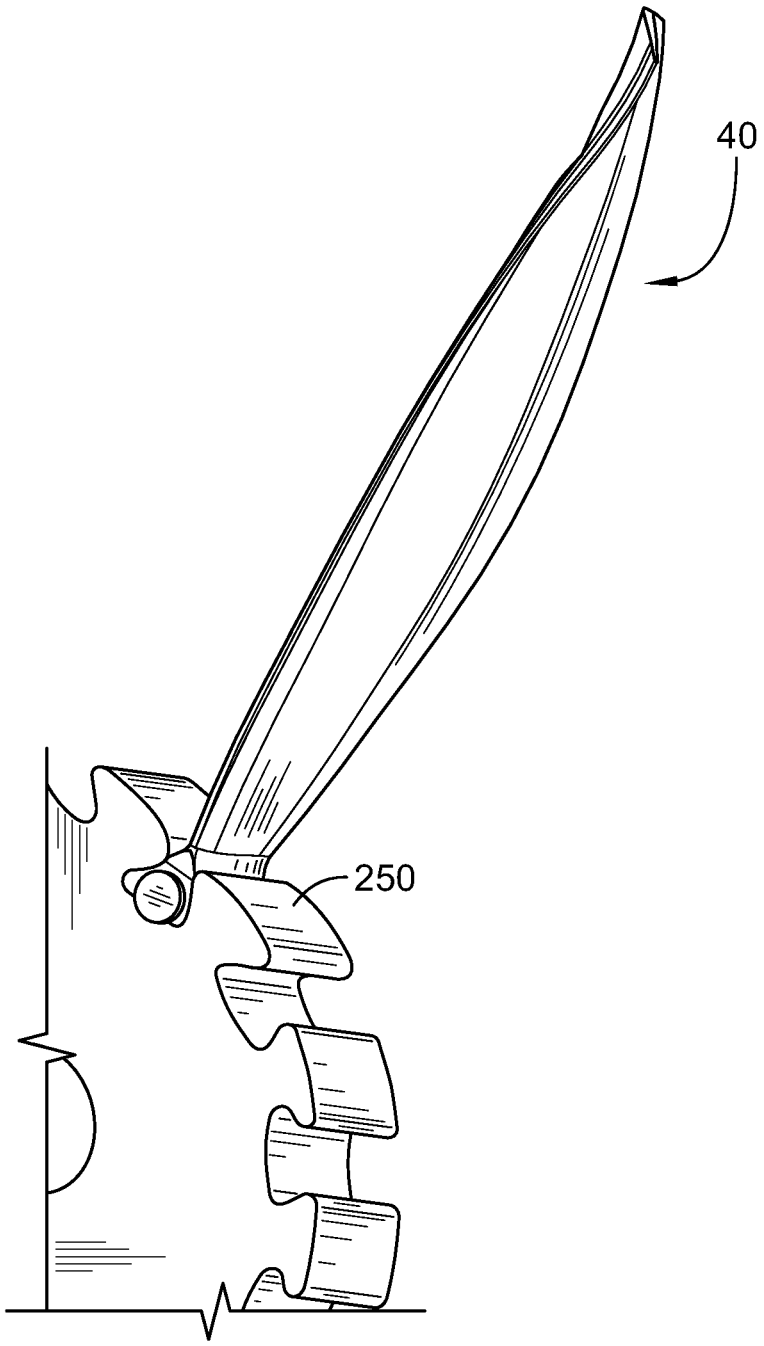
FIG. 9 is a perspective view of a fan blade assembly coupled to a disc.

Referring to FIG. 9, the fan blade assembly 40 may be coupled to a disc 250 using either the blade retainer 130 or the blade retainer 220.

In the embodiments described herein the overall length of the blade restraint is approximately equal to the dovetail length. This reduces the total bearing area of the dovetail, thus limiting blade robustness.

In a variable pitch fan blade designs, each blade is independent of each other therefore the prying force to open the dovetail has no counteracting force. This can exert force on the dovetail that not only creates high bending forces, but generates edge loading on the corners of the dovetail. Given solidity constraints at the hub, there may be less bearing area to support the dovetail blade load. Point loading and edge of bedding have been a consistent problem in composite blade design. This edge loading can cause initiation of failure on composite root designs. This failure can propagate quickly under blade vibrations. Designs in accordance with the present disclosure can be used in solutions to these challenges.

Variable pitch fan blade design can also be challenged because of solidity constraints near the hub. Some fixed pitch fans usually have solidity greater than 1 while variable pitch fans have constraints less than 1. The solidity is constrained by the fact that the blades need to rotate past each other without clashing. A compact axial retention system provided by the disclosed designs and can prevent the blade from sliding out under aero or bird strike loads. The more the axial retention sticks out, the further the blade solidity has to be reduced. The solidity also drives hub to tip diameter ratio. Some fixed pitch designs use a shear key integrated into the dovetail. This can add length to the dovetail slot because it is done on both the forward and aft end, thus increasing overall length.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A blade assembly for use with a gas turbine engine, the blade assembly comprising a blade configured to rotate about a center axis during operation of the gas turbine engine, the blade including a root and an airfoil that extends radially away from the root, a blade holder configured to support the blade as the blade rotates about the center axis, the blade holder including a base, a first post, and a second post that cooperate to define a blade receiver slot that extends axially through a fore face and an aft face of the blade holder and that receives the root of the blade such that the first post and the second post block radial movement of the root of the blade out of the blade receiver slot, and a blade retainer configured to block axial movement of the root of the blade out of the blade receiver slot, the blade retainer including an outer stop and a retainer insert that includes a web that extends axially between a fore end and an aft end, a fore brace coupled to the fore end of the web, and an inner stop that extends radially inward away from the web adjacent the aft end of the web, wherein the outer stop is aligned axially with the inner stop and coupled to the web to cause the outer stop and the inner stop to cooperate to provide an aft brace that is spaced apart axially from the fore brace, the fore brace is configured to engage the root of the blade and the fore face of the blade holder, the aft brace is configured to engage the root of the blade and the aft face of the blade holder, and the web blocks relative movement between the fore brace and the aft brace so that the blade retainer blocks axial movement of the root of the blade out of the blade receiver slot, wherein the outer stop includes a radially extending abutment wall and a flange that extends axially away from the abutment wall and the web is formed to include a channel that extends radially into a radially outward facing surface of the web and a portion of the abutment wall is slidably received in the channel to locate the outer stop axially relative to the retainer insert, and wherein the blade retainer further includes a fastener having a primary axis that extends radially relative to the center axis of the gas turbine engine so that the fastener extends radially through the flange of the outer stop and the aft end of the web to couple the outer stop to the retainer insert.

2. The blade assembly of claim 1, wherein the channel is aligned axially with the inner stop.

3. The blade assembly of claim 1, wherein the outer stop is removably coupled to the retainer insert.

4. The blade assembly of claim 1, wherein the fore brace is solid, continuous, and circular when viewed axially relative to the center axis.

5. The blade assembly of claim 4, wherein the fore brace, the web, and the inner stop are integrally formed as a single component.

6. The blade assembly of claim 1, wherein the fore brace is solid, continuous, and rectangular when viewed axially relative to the center axis.

7. A blade assembly comprising a blade retainer that includes an outer stop and a retainer insert that includes a web having a first end and a second end spaced apart axially from the first end relative to an axis, a first brace that extends radially outward and radially inward away from the web at the first end of the web, and an inner stop that extends radially inward away from the web axially between the first end and the second end of the web, wherein the outer stop is coupled to the web at the second end of the web to cause the outer stop and the inner stop to provide a second brace, wherein the outer stop includes a radially extending abutment wall that is axially aligned with the inner stop to provide the second brace and a flange that extends axially aft away from the abutment wall and has a radially inward facing surface that engages a radially outwardly facing surface of the web, and wherein the web is formed to include a channel that extends radially into the radially outward facing surface of the web and a portion of the abutment wall is slidably received in the channel to removably couple the outer stop to the web of the retainer insert and to locate the outer stop axially relative to the retainer insert so that an axially forward facing surface of the abutment wall of the outer stop and an axially forward facing surface of the inner stop are located in the same plane.

8. The blade assembly of claim 7, wherein the channel is aligned axially with the inner stop.

9. The blade assembly of claim 8, wherein the blade retainer further includes a fastener that extends through the flange of the outer stop and the second end of the web to couple the outer stop to the retainer insert.

10. The blade assembly of claim 8, wherein the blade retainer further includes a bond layer located between the flange of the outer stop and the second end of the web to couple the outer stop to the retainer insert.

11. The blade assembly of claim 7, further comprising a blade holder having a fore face and an aft face spaced apart from the fore face, and a blade having a root and an airfoil that extends away from the root, the root of the blade is received in the blade holder, the web of the blade retainer is located between the root of the blade and the blade holder, the first brace is adapted to engage with the fore face of the blade holder, and the second brace is adapted to engage with the aft face of the blade holder.

12. The blade assembly of claim 7, wherein the web has a circumferential width, the first brace has a circumferential width, and the circumferential width of the first brace is equal to the circumferential width of the web.

13. A method of making a blade retainer adapted to block axial movement of a blade in a gas turbine engine, the method comprising providing a first segment of a bar stock comprising metallic material, removing material from the first segment of the bar stock to form an integral retainer insert that includes a web that extends axially relative to an axis of the bar stock between a fore end and an aft end, a first brace that extends radially outward and radially inward away from the web at the fore end of the web, and an inner stop that extends radially inward away from the web adjacent to the aft end of the web, the first brace being spaced apart axially from the inner stop, removing material away from the web to form a channel that extends radially into a radially outward facing surface of the web, providing a second segment of the bar stock, removing material from the second segment of the bar stock to form an outer stop that includes a radially extending abutment wall and a flange that extends axially away from the abutment wall, and sliding a portion of the abutment wall into the channel to removably couple the outer stop to the web of the retainer insert and to locate the outer stop axially relative to the retainer insert so that an axially forward facing surface of the abutment wall of the outer stop and an axially forward facing surface of the inner stop are located in the same plane.

14. The method of claim 13, wherein the bar stock is cylindrical.

* * * * *